United States Patent [19]

Tsilibes

[11] Patent Number: 4,969,013

[45] Date of Patent: Nov. 6, 1990

[54] APPARATUS AND METHOD FOR DIGITIZING A DOCUMENT FOR SELECTIVE AREA TREATMENT

[75] Inventor: George N. Tsilibes, Rochester, N.Y.

[73] Assignee: Eastman Kodak Company, Rochester, N.Y.

[21] Appl. No.: 365,580

[22] Filed: Jun. 13, 1989

[51] Int. Cl.[5] ..... G03G 15/00

[52] U.S. Cl. ..... 355/218; 355/202; 355/77; 355/328

[58] Field of Search ..... 355/218, 200, 77, 328, 355/202

[56] References Cited

U.S. PATENT DOCUMENTS

| | | | |
|---|---|---|---|
| 4,740,818 | 4/1988 | Tsilibes et al. . | |
| 4,766,404 | 8/1988 | Ishida et al. | 355/218 X |
| 4,806,976 | 2/1989 | Kato et al. | 355/202 |
| 4,806,978 | 2/1989 | Nakatani et al. | 355/202 |
| 4,812,875 | 3/1989 | Tanimoto . | |
| 4,862,217 | 8/1989 | Russel | 355/218 |
| 4,866,474 | 9/1989 | Kinoshita et al. | 355/218 |
| 4,887,128 | 12/1989 | Jamali et al. | 355/218 x |
| 4,903,077 | 2/1990 | 355 | 218 X/4,866,474 |

FOREIGN PATENT DOCUMENTS 62-102239 5/1987 Japan .

OTHER PUBLICATIONS

Mini-Micro Systems, Dec. 1984, p. 19, "Printer Add-On Helps Paper Remember".

*Primary Examiner*—R. L. Moses

*Attorney, Agent, or Firm*—Norman Rushefsky

[57] ABSTRACT

A reproduction apparatus and method for digitizing a document original for providing selective area treatment during reproduction of the original. The method and apparatus employs a paper or transparent plastic sheet with a magnetic coating over the surface thereof. The magnetic coating is pre-recorded with a grid pattern. The sheet is placed upon a document original to be digitized and the wand is moved over the magnetic sheet until stopped at specific points of interest on the original. Pulses generated by the flux sensor in the wand are counted and comprise data defining the location of these points. The digitized document is then copied by the reproduction apparatus and the reproduction process modified to provide selective erase, accent color, selective screening, annotation, etc. The wand may also include a magnetic write head to record the digital data on the magnetic sheet. This provides a storable magentic record of the digitization process. The magnetic sheet may then be used as a "key sheet" in a document feeder to set up a copy operation with selective area treatment for the document original.

24 Claims, 5 Drawing Sheets

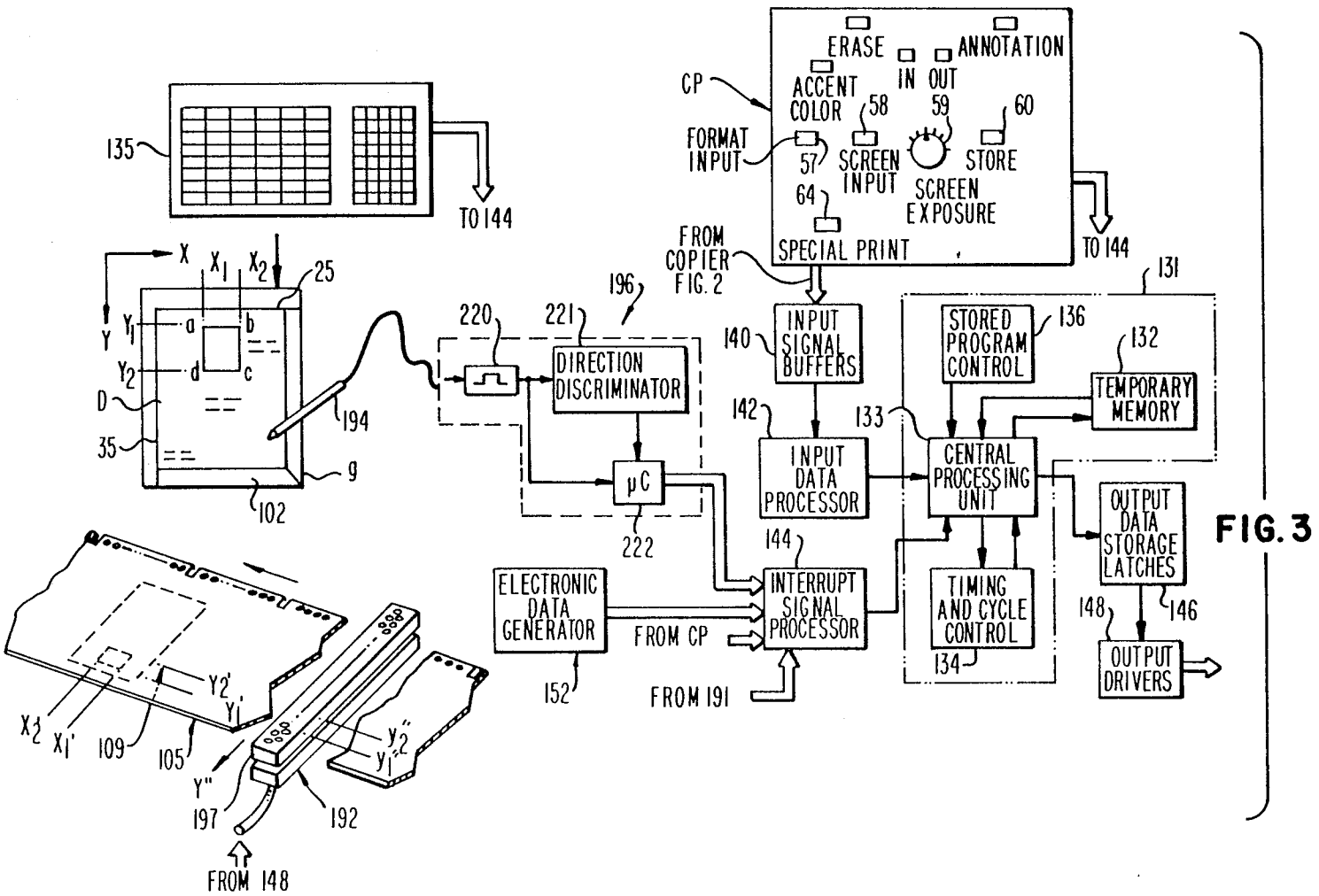
FIG. 3
ANNOTATION
ERASE
IN OUT
59
STORE
60
ACCENT COLOR
57
SCREEN INPUT
58
SCREEN EXPOSURE
64
SPECIAL PRINT
CP
FORMAT INPUT
FROM COPIER FIG. 2
TO 144
131
132
TEMPORARY MEMORY
136
STORED PROGRAM CONTROL
133
CENTRAL PROCESSING UNIT
134
TIMING AND CYCLE CONTROL
146
OUTPUT DATA STORAGE LATCHES
148
OUTPUT DRIVERS
140
INPUT SIGNAL BUFFERS
142
INPUT DATA PROCESSOR
144
INTERRUPT SIGNAL PROCESSOR
FROM 191
FROM CP
152
ELECTRONIC DATA GENERATOR
196
221
DIRECTION DISCRIMINATOR
222
μC
220
194
9
102
25
X
X1
X2
Y
Y1
Y2
a
b
c
d
D
35
135
TO 144
192
197
FROM 148
105
109
Y'
Y1'
Y2'
X1'
X2'
Y1''
Y2''

APPARATUS AND METHOD FOR DIGITIZING A DOCUMENT FOR SELECTIVE AREA TREATMENT

CROSS-REFERENCE TO RELATED APPLICATIONS

This application is related to U.S. application Ser. No. 365,332, filed on even date herewith in the name of Norman Rushefsky and entitled "Digitizer Apparatus and Method."

BACKGROUND OF THE INVENTION

1. Field of the Invention

The present invention relates to reproduction apparatus and methods and more specifically to apparatus and methods for digitizing or identifying areas of documents for special treatment when reproducing same.

2. Brief Description of the Prior Art

In U.S. Pat. No. 4,740,818 electrophotographic reproduction apparatus is described in which a document original to be reproduced is placed upon an exposure platen and a wand used by an operator to select points on the original which define an area for selective treatment such as selective screening. Other known functions for reproducing the original include selective erase of certain areas of the original, selective coloration or accent coloring, selective annotation, etc. While the apparatus described in the forementioned patent works well, it would be desirable to provide less costly alternatives.

It is, therefore, an object of the invention to provide an inexpensive digitizer for use in reproducing documents with selective area treatment.

Summary of the Invention

The method and apparatus of the invention are directed to digitizing a document sheet to identify the location of one or more points thereon by placing a sheet having a grid pattern upon the document; moving a sensor that is sensitive to said grid across the grid sheet to a point to be digitized; generating pulses in said sensor in response to such movement; counting the pulses generated; and in response to such count, generating a signal representative of the digitized value of said point.

In accordance with another aspect of the invention, a method is described for reproducing a document sheet so that reproductions thereof are provided with a selective area treatment said method comprising the steps of:

placing a sheet having a magnetic material upon the document sheet to be reproduced with a selective area treatment; moving a magnetic writer across the sheet to record on the magnetic sheet an area or one or more points identifying an area of the document sheet to receive a selective area treatment; reading the magnetic sheet in a magnetic reader to generate signals related to the area selected for selected area treatment; and in response to said signals adjusting a reproduction operation for reproducing said document sheet so that a reproduction(s) thereof is produced with said selective area treatment.

BRIEF DESCRIPTION OF THE DRAWINGS

The subsequent description of the preferred embodiments of the present invention refers to the attached drawings wherein:

FIG. 3 is a schematic illustrating a data input station and block diagrams of controls for controlling the apparatus shown in FIG. 2;

DETAILED DESCRIPTION OF THE PREFERRED EMBODIMENTS

Because electrophotographic reproduction apparatus are well known, the present description will be directed in particular to elements forming part of or cooperating more directly with the present invention. Apparatus not specifically shown or described herein are selectable from those known in the prior art.

Figure 1:
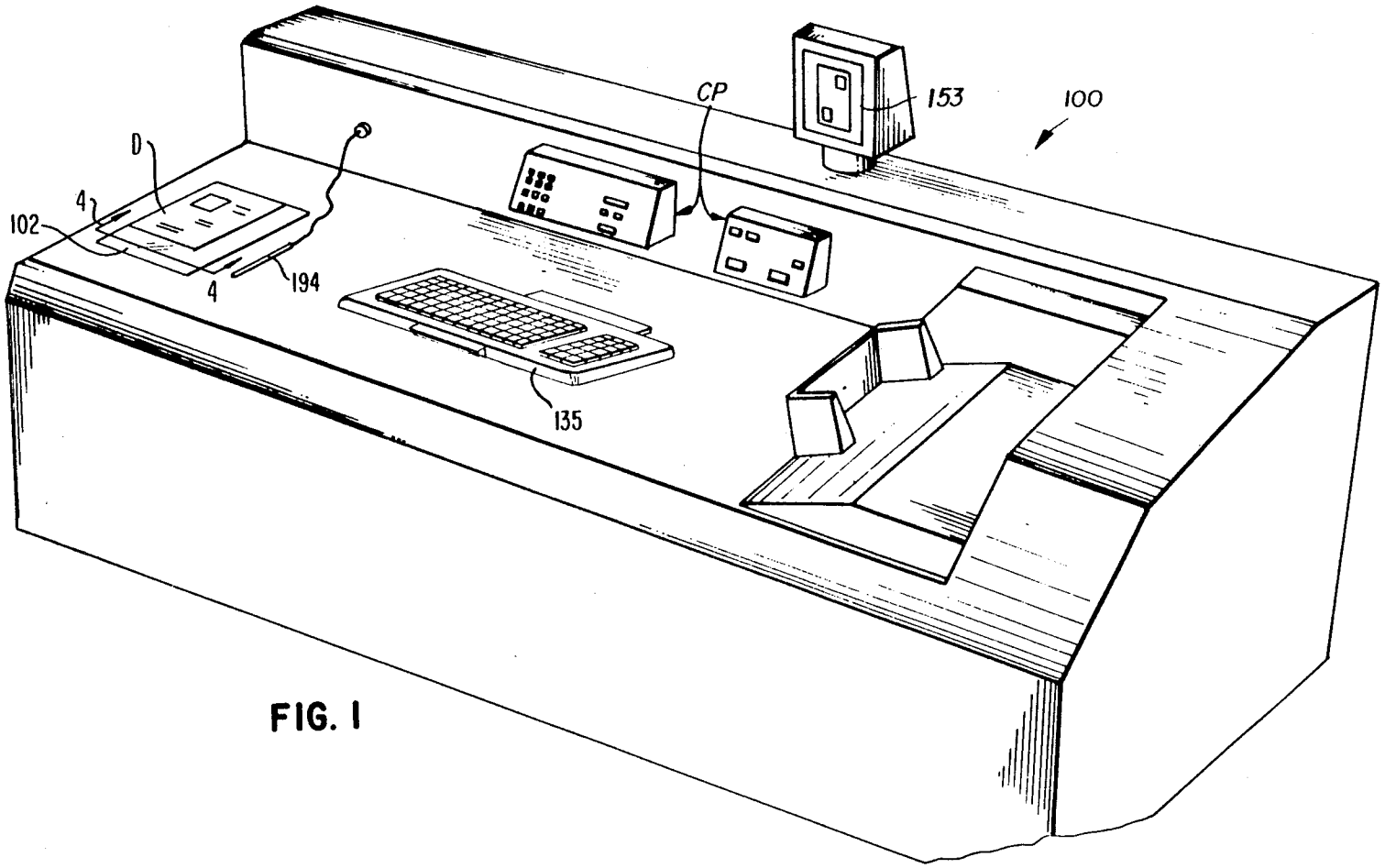
FIG. 1 is a perspective view of one embodiment of electrophotographic apparatus for practice of the present invention.
Figure 2:
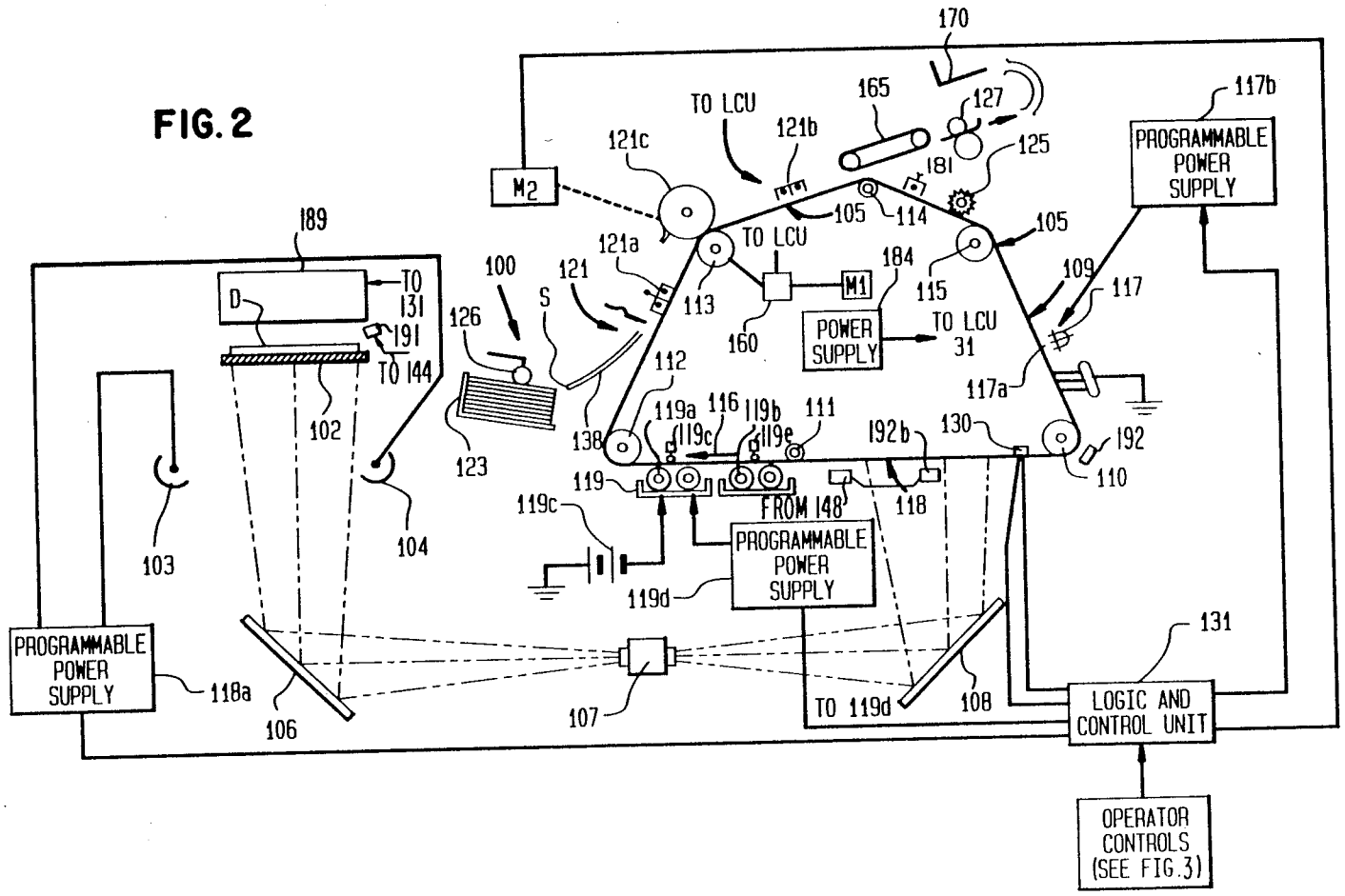
FIG. 2 is a schematic front elevational view of the apparatus of FIG. 1 and showing the general arrangement of electrophotographic reproduction apparatus that is in accordance with the invention.

With reference now to FIGS. 1 and 2, an electrophotographic reproduction apparatus 100 includes a photoconductive web 105 that is trained about six transport rollers 110, 111, 112, 113, 114 and 115, thereby forming an endless or continuous web. Roller 113 is coupled to a drive motor Ml in a conventional manner. Motor Ml is connected to a source of potential when a switch (not shown) is closed by a logic and control unit (LCU) 131. When the switch is closed, the roller 113 is driven by the motor Ml and moves the web 105 in clockwise direction as indicated by arrow 116. This movement causes successive image areas or image frames of the web 105 to sequentially pass a series of electrophotographic work stations of the copier.

For the purpose of the instant disclosure, several copier work stations are shown along the web's path. These stations will be briefly described.

First, a charging station 117 is provided at which the photoconductive surface 109 of the web 105 is sensitized by applying to such surface a uniform electrostatic primary charge of a predetermined voltage The station 117 includes an A.C. corona charger. The output of the charger is controlled by grid 117*a* connected to a programmable power supply 117*b*. The supply 117*b* is in turn controlled by the LCU 131 to adjust the voltage level Vo applied onto the surface 109 by the charger 117.

At an exposure station 118, a light image of a document sheet D, supported on transparent platen 102, is projected by mirrors 106, 108 and lens 107 onto the photoconductive surface 109 of the web 105. While the apparatus will be described with respect to reflection exposure of the original document sheet onto the photoconductive surface, the use of transmission exposures of an original is also contemplated by the invention. The projected image dissipates the electrostatic charge at the light exposure areas of the photoconductive surface 109 and forms a latent electrostatic image. A programmable power supply 118*a*, under the supervision of the LCU 131, controls the intensity or duration of light from flash lamps 103 and 104 to adjust the exposure level E incident upon the web 105.

Two development stations 119*a* and 119*b* are provided. Each includes developer which may consist of iron carrier particles and electroscopic toner particles with an electrostatic charge opposite to that of the latent electrostatic image. Developer is brushed over the photoconductive surface 109 of the web 105 and toner particles adhere to the latent electrostatic image to form a visible toner particle, transferable image. The development station may be of the magnetic brush type with one or two rollers. One developer station 119*a* includes toner particles of one color, say black, the other station 119*b* includes toner particles of a second color, say red. A suitable electrical bias to the station is provided by programmable power supply 119*d*. Back-up rollers or the like 119*c* and 119*e* are provided and associated with a respective development station and selectively activated by LCU 131 to control which development station is to apply toner to the web 105.

The apparatus 100 also includes a transfer station 121 shown as a corona charger 121*a* at which the toner image on web 105 is transferred to a copy sheet S; and a cleaning station including charger 181 and brush 125, at which the photoconductive surface 109 of the web is cleaned of any residual toner particles remaining after the toner images have been transferred. After the transfer of the unfixed toner images to a copy sheet S, such sheet is transported by conveyor belt 165 to a heated pressure roller fuser 127 where the image is fixed to the copy sheet S and delivered to an output tray 170.

As shown in FIG. 2, a copy sheet S is fed from a supply 123 by a roller 126. The copy sheet may then be driven by continuous driven rollers (not shown) which then urge the sheet against a suitable registration mechanism ( not shown). The copy sheet is then released and moves forward onto the web 105 in alignment with a toner image at the transfer station 121.

To coordinate operation of the various work stations with movement of the image areas on the web 105 past these stations, the web has a plurality of perforations along one of its edges. These perforations generally are spaced equidistantly along the edge of the web 105. For example, the web 105 may be divided into six image areas or image frames by F perforations, and each image area may be subdivided into 51 sections by C perforations. The relationship of the F and C perforations to the image areas is disclosed in detail in commonly assigned U.S. Pat. No. 3,914,047 filed in the name of Hunt, Jr. et al and issued Oct. 21, 1975. At a fixed location along the path of web movement, there is provided suitable means 130 for sensing web perforations. Additional encoding means 160 may also be provided for providing more precise control. This sensing produces input signals into the LCU 31 which has a digital computer, preferably a microprocessor. The microprocessor has a stored program responsive to the input signals for sequentially actuating then deactuating the work stations as well as for controlling the operation of many other machine functions as disclosed in U.S. Pat. No. 3,914,047. Additional encoding means 160 may be provided as known in the art for providing more precise timing signals for control of the various functions of the apparatus 100.

Programming of a number of commercially available microprocessors such as an INTEL model 8086 microprocessor (which along with others can be used in accordance with the invention), is a conventional skill well understood in the art. This disclosure is written to enable a programmer having ordinary skill in the art to produce an appropriate control program for the one or more microprocessors used in this apparatus. The particular details of any such program would, of course, depend on the architecture of the designated microprocessor.

Figure 4:
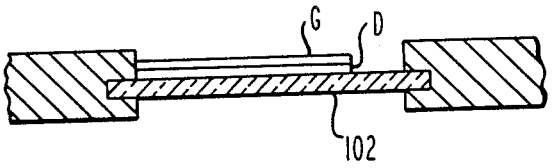
FIG. 4 is an elevational view in cross-section illustrating the exposure platen of the apparatus of FIG. 1 with a document original thereon.

With reference also now to FIG. 4, a block diagram of logic and control unit (LCU) 31 is shown which interfaces with the apparatus 100. A document feeding apparatus 189 may also be provided that includes known recirculating feeder and document positioner means. Details of a known document feeding apparatus may be found, for example, in U.S. Pat. No. 4,451,137, issued May 29, 1984 in the name of Farley.

The LCU 131 consists of temporary data storage memory 132, central processing unit 133, timing and cycle control unit 34 and stored program control 136. Data input and output is performed sequentially under program control. Input data are supplied either through input signal buffers 140 to an input data processor 142 or to interrupt signal processor 144. The input signals are derived from various switches, sensors and analog-to-digital converters. The output data and control signals are applied to storage latches 146 which provide inputs to suitable output drivers 148, directly coupled to leads. These leads are connected to the various work stations, mechanisms and controlled components associated with the apparatus. An electrical power supply 184 is provided to power the LCU 131.

Also shown in FIG. 4 is an operator control panel CP and the exposure platen 102 which in this example may serve as the support for digitizing document sheet D. In addition to the function keys shown other keys (not shown) are provided including the usually provided keys for designating the number of copies, etc. and a start button for beginning a copy operation. Document sheet D includes continuous tone pictorial information (or more generally information to be reproduced with the selective screening process described herein) in the area defined by rectangle a,b,c and d and line-type information (such as alphanumerics, or generally information not to be reproduced with the selective screening process described herein) in the background areas. A corner of the document sheet is registered in one corner of the platen to establish a coordinate reference system for inputting information into temporary memory 132 regarding the location of the areas containing the continuous tone pictorial information. To enable the LCU 131 to receive this information and other information for operating the apparatus, the operator control panel CP and a keyboard 135 are provided on the operator control panel and connected to interrupt signal processor 144. A special print button 64 on the control panel is used by the operator to access a program stored in stored program control 136 for a selective area treatment. Through a CRT or other display 153 (FIG. 1) requests are made that the operator place the original document sheet D face-up upon the exposure platen and register a corner of the sheet with the appropriate corner reference of the platen. The operator is further instructed to place a digitizing sheet, to be further described, upon the document sheet also in register with the corner reference of the platen. The operator is then requested to employ a wand 194 to enter the format of the document sheet original; i.e., size of the original. This is done by moving the wand so as to identify either points e and f or alternatively point g which identifies the size of document D. The operator is then requested to select which special area treatment is desired; i.e., selective screening, accent color, selective erase, annotation. Description will now be provided with respect to selection of the selective screening option.

Details of the wand and apparatus and method for digitizing will now be discussed.

With reference now to FIG. 4, the glass exposure platen 102 is shown supporting the original document sheet D. Upon the original document sheet is placed a transparent sheet G of say plastic coated with first and second layers, each of which includes magnetic particles. These magnetized sheets have magnetically recorded thereon grid patterns over the portion of the surface thereof which covers the original document sheet. In the first layer a grid pattern may be magnetically recorded in one direction and in the second layer the grid pattern is recorded in a second direction perpendicular to the first direction. This magnetic recording may be provided by known magnetic read/write heads that are programmed to record a grid pattern on the magnetized sheet.

Figure 5:
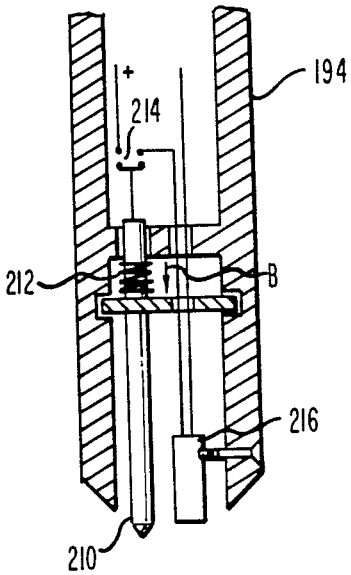
FIG. 5 is a schematic of a portion of digitizing wand for use with the apparatus of the invention.
Figure 6:
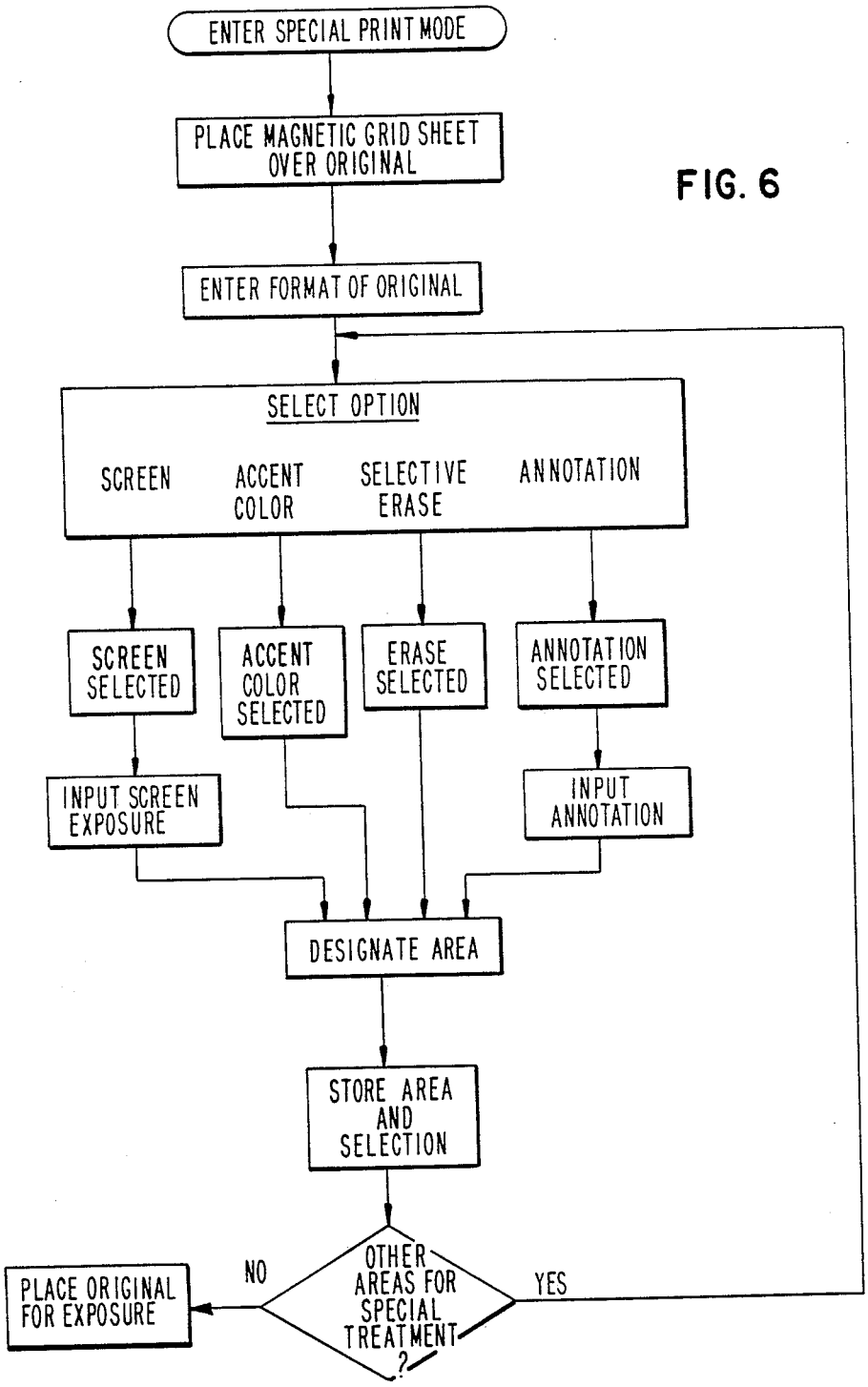
FIG. 6 is a flowchart illustrating the steps for operator selection of selective area treatments in accordance with the invention.

With reference now also to FIG. 5, a portion of the digitizing wand 194 is shown. This wand includes an ink-containing pen 210 that is biased by spring 212 in the direction shown by arrow B. Upon use of the wand by placement of the pen point upon the surface of the magnetized sheet, a switch 214 is closed which energizes a flux-sensing head 216 in the wand. In order to digitize or identify a point, the wand is placed at the top reference edge of the platen and moved over the magnetized sheet G in a direction parallel to an opposite reference edge. For example, with reference to FIG. 3 to digitize point "a" on document sheet D, the wand 194 is moved from the reference edge 25 parallel to reference edge 35 until point "a" on sheet D is reached. In response to the wand traversing the magnetized grid lines on the magnetized sheet, pulses are generated and sent to the digitizer's logic electronics which counts the number of pulses and translates same into $Y_1$, one of the two coordinates for point "a". The other coordinate is determined similarly but by moving the wand from reference edge 35 parallel to reference edge 25 until point "a" is reached. The pulses created determines the coordinates, $X_1$, $Y_1$. The location of point "a" is thus identified. In like manner, each of the other coordinates requiring digitization or determination as to location relative to the corner reference is made. Alternatively, once the position of point "a" is defined relative to the corner reference the other points, b, c and d may be defined by movement of the wand along the perimeter of the rectangle to be formed. With the wand moved by the operator and starting at point a, the circuitry in digitizer 196 for translating the electrical pulse signals into coordinate data can determine directionality by discriminating between whether movement is in the X or Y directions. This can be provided for by having two read heads provided in the wand. One head is oriented to read the grid pattern in the X direction of the sheet and the other read head is oriented perpendicular to the first and adapted to read the grid pattern in the Y direction. Thus, changes in direction of movement of the wand are determined and a corner point of the rectangle defined at the location of the change of direction. The digitizer circuitry for detecting the points defined by the rectangle may comprise a pulse shaper and amplifier 220 for amplifying the pulse signals from the flux sensing heads 216, a direction discriminator which senses the amplified pulses from the pulse shaper and generates a one-bit digital signal indicative of the direction in which the pulses are generated; and a microcomputer 222 which is programmed to count the pulses from the amplified pulses and which receives the one-bit directional signal. Those signals are used by the computer to determine the positions of the various vertices of rectangle abcd. A protocol is also provided so that once point "a" is established, point "b" is located to the right; of point "a", point "c" is located below point "b", etc.

It is also known to digitize a document sheet while it is placed face down. This avoids the need to retranslate the data obtained because the document has been turned over. When the document original is placed face down upon the exposure platen, lamps beneath the platen may be illuminated to back light the original so that sufficient details in the document are viewable by the operator to be able to stop movement of the wand at the desired points. As noted above, the invention is also useful where the document original is placed face-up for digitizing. Where the digitizing sheet containing the magnetic grid is paper and not transparent, backlighting may also be used to display image information on the document original through the magnetized paper sheet. Of course, no backlighting need be used where the document sheet original is face-up and the magnetized grid sheet is transparent. The wand 54, while traversing the surface of the magnetized sheet, provides a visual record of the points.

The use of the exposure platen for digitization provides the advantage of no or minimal movement of the document from the operation of digitization to exposure for purposes of reproduction. It is also preferred to allow access to others to the copier for copying other jobs while digitization is being done. To this end, the digitizer of the invention lends itself to an off-line useage wherein a document may be digitized against suitable reference edges. A backlight source need only be provided if a document is digitized face down and/or the magnetized sheet is paper. Where the magnetized grid sheet is transparent and the document is registered face-up, the costs of such a digitizer are even further minimized. A memory may be provided for storing the digitized data or as will be described the data for identifying the area to receive selective treatment is stored on the magnetic grid sheet.

While the magnetized grid sheet G is described as being placed over the original document sheet, it is possible to place the magnetized sheet beneath the original although some resolving ability may be lost by doing this. In any event, the term "upon" is used herein to imply either placement.

In the event it is desired not to mark up the original, the wand may be provided either without a pen or a retractable penpoint. A manually operated switch may be used to energize the wand.

For the rectangular continuous tone pictorial area abcd shown, the wand may be used to identify this area at the four corner points of this area. Preferably, the points are identified in an order such that a straight line joins adjacent points as in the order a,b,c, and d to define a rectangle. The computer control for the digitizing may also be programmed to accept inputs of area data to define other geometrical shapes such as circles. The controller 56 for the digitizing wand is programmed to recognize that the area is bordered by the straight lines joining adjacent points a, b,c, and d and the coordinates for the area to be selectively screened can be thus calculated and communicated through interrupt signal processor 40 to be stored in temporary memory 32. This information is outputted on the display 53 showing the area to be screened. The coordinates for the points a, b, c and d would be $x_1$, $y_1$; $x_2$, $y_1$; $x_2$, $y_2$; and $x_1$, $y_2$, respectively.

When introducing screen input information the operator will also adjust a screen exposure knob 59 which provides a means of adjusting the level of screen exposure for the particular area identified for screening. After the screen area is defined using the wand and the screen exposure level defined using the knob, a store button 60 is pressed to retain this information in memory. Inputs from each of the buttons and knob provide digital level signals to the interrupt signal processor 144 for storage in the LCU's temporary memory 132.

After the information is provided concerning areas a,b,c and d, the operator may repeat this operation for additional areas to be specially or selectively treated for reproduction of this document. Assuming this information is input, the operator is instructed to turn the document face down in a registered position upon the exposure platen 102. Suitable logic or computing means may be provided in the digitizer or LCU 131 to translate the data points determined during the digitizing step for a plane or axes X, Y in the plane of the digitizing tablet to that of X', Y' on an image frame of the photoconductor's surface 109.

As previously described, image exposure is effected by flash lamps 103 and 104, which form a latent electrostatic image of the document sheet upon an image frame of the web. Formation of a plurality of charge islands within the latent electrostatic image is effected by a second exposure upon the web by an LED printhead 192. This second exposure may be carried out prior to, simultaneous with, or after image exposure of the photoconductor, the only requirement being that this second exposure be carried out after charging by charger 17 and prior to development.

With reference again to FIG. 3, there is shown the printhead 192 for simulating a screen-like exposure upon the web. The printhead 192 comprises a plurality of light-emitting diodes (LED's) arranged in a row. These LED's are coupled to the output drivers 148 of the LCU 131. Optical fibers are associated with the LED's for imaging light from the LED's onto the photoconductor. Such fibers may be arranged as a conventional gradient index lens array (GRIN) 197, such as a SELFOC (trademark of Nippon Sheet Glass Co., Ltd.) array.

Prior to or as the frame on the photoconductive web upon which the image of the document sheet is to be formed passes above the GRIN, the LCU calculates which of the LED's to illuminate and the duration of such exposure. As shown in FIG. 3, the portions of the GRIN between the ordinates $y''_1$, $y''_2$ on the Y'' axis of the linear GRIN correspond to their respective counterparts on the original document and to their respective ordinate counterparts $y'_1$, $y'_2$ and on the y' axis of the image frame. These ordinate pairs each define a transverse line past which a respective latent electrostatic continuous tone image area on the photoconductor will pass. When this area, which corresponds to that for reproduction of the continuous tone information, begins to pass directly above the printhead, the appropriate LED's are illuminated by the LCU. The illumination provided by the selected LED's is created by a series of pulses to them so that light from the LED's forms a simulated screen pattern upon the area of the image frame corresponding to rectangle a,b,c and d. The parameters for determining the timing of when to commence pulsing of the LED's when to terminate same are provided by the abscissa pairs $x'_1$, $x'_2$ of the image frame, respectively. Thus, when the portion of the image frame corresponding to the transverse line $x'_1$, as determined by signals provided by the LCU, underlies the printhead the LED's providing illumination between $y''_1$ and $y''_2$ commence to be rapidly pulsed. This pulsing lasts until the transverse line $x'_2$ (also determined by the LCU passes by the printhead.

Thus, a latent electrostatic image of a screen pattern is imaged upon the charged web by the second exposure source substantially only in the area of the image frame upon which the continuous tone image is to appear and, importantly, no screened exposure is to be provided outside of this area. The image of the document D is subsequently in this example superimposed upon the image frame by activation of flashlamps 103, 104 to further modulate the electrostatic charge. The charged image pattern is then developed with the appropriate colored toner by actuation of the appropriate back-up roller, either **119*c* or 119*e***, and the developed image frame transformed to a receiver sheet S' as described above. There is thus provided a reproduction with an area thereof that has been selectively treated vis-a-vis that of the original.

While the invention has been described with regard to one type of array using an LED light source, it will be appreciated that others may be substituted. For example, laser may be substituted for the LED's.

While the invention has been described in terms of selectively screening an area in accordance with techniques more fully described in U.S. Pat. No. 4,740,818, the contents of which are incorporated herein, the invention is directed broadly to selective area treatment in reproducing documents and may include selective erase of information from areas of a document original, accent coloring, annotation etc. In selective erase an area of the document is designated and the erase source such as an LED eraser or printer, used to expose selected areas of the electrostatically charged photoconductor's image frame used to reproduce this document. These areas generally border the image area(s) that is to be saved and do not receive toner when the image frame is developed. The respective button on the control panel CP and labelled "ERASE" is used for selecting this option as well as buttons labelled "IN" or "OUT" for identifying the area to be erased; i.e., is the area to be erased within or without the area selected. In the selective erase mode, the appropriate LED's are driven so that their exposures overlap to erase charge completely or at least to a level below which development can occur in those areas to be erased. In accent coloring, selected via the "ACCENT COLOR" button, two image frames may be employed with the copier having two development stations with different colored toners. The original is exposed onto the two image frames and the LED printhead erases complementary selected areas from each image frame. The unerased areas in each image frame are developed with respective colored toners and the developed two image frames transferred in register to the same surface of a copy sheet. More particularly, the two developed image frames are transferred in register to the copy sheet S using transfer charger **121*a* to transfer the toner image of one developed image frame to sheet S; a transfer vacuum roller 121c, upon which the sheet circulates until in register with the next image frame; and transfer charger 121b, which transfers a reproduction of the image present on the second image frame to the same surface of the copy sheet. The registered images are then transported by vacuum belt 165 to fuser rollers 127 which fix the images upon the copy sheet. Thus, a reproduction is formed of the original document but with one area reproduced in one color and a second area reproduced in a second color although the original may only have been of one color. In selective annotation, selected via the "ANNOTATION" button, an area of an original may be blocked from the optical exposure and selected information written by the LED printhead into the area of the photoconductor's image frame that has been blocked. An electronic data generator 152 may be provided to supply the data signals to be printed. As may be noted schematically in FIG. 3, a mask 192b may be moved into the optical exposure path either by operation of a solenoid or motor in response to signals from the LCU 131**. The mask blocks the optical exposure in an area of the image frame thereby leaving undisturbed the exposure in that area by the LED printhead.

While the invention has been described with reference to an optical exposure system, it is contemplated that all exposures may be carried out by an electro-optical source such as an LED printhead or laser wherein the selective area treatment is accomplished by modifying electronically the data that is printed by the electro-optical source. For example, the information on the document may be scanned and converted into electronic signals. These signals may then be modified with the digitized data and the electronic print source activated to expose an image frame(s) with the combined data.

The wand 194 may also incorporate a write head which erases selected points. For example, after point "a" is reached, a button may be pressed enabling the write head. As the wand traverses the area, the outline of the area is erased and can be detected by a magnetic reader. A code may be placed in the margin of the sheet using the wand to identify the type of selective area treatment to be performed upon the sheet, as well as the number of copies and other copier operations. The magnetic grid sheet may thus be placed in a stack of the recirculating feeder with the original document sheet, the stack including also other original documents to be reproduced with their respective magnetic grid sheets. The grid sheets thus comprise "key sheets" that may be advanced by the feeder to a magnetic reader unit 191 for setting the operation of the copier 100 for the next original document sheet fed to the exposure platen. The reader 191 generates signals read from the codes provided in the margin. These signals are fed to the interrupt signal processor and used by the LCU to set the copier for the particular copying operation, i.e., the number of copies, accent color, selective erase, annotation, etc. The area to receive the special treatment is then read by the reader, as the reader can relate this recorded area either to a reference coded on the grid sheet or to a corner of this sheet. This data, too, is fed to the LCU 131 via interrupt signal processor 144 and the area for selective treatment calculated. The selective treatment operation would then be performed in accordance with the techniques described above. The magnetic reader unit would be located adjacent the path of movement of the stack of documents in the feeder's hopper past the magnetic reader, across the exposure platen—where the magnetic sheet is not exposed—and back to the top of the stack. The detection of the magnetic sheet by the magnetic detection unit 191 sets a signal to the LCU to inhibit the exposure lamps and to provide continued circulating conveyance of the magnetic sheet rather than stopping same for an exposure. The next sheet in the stack to be transferred towards the platen will be the document original that is to be exposed and reproduced in accordance with selective area treatment parameters defined in the previous magnetic sheet.

As the magnetic grid sheet has areas thereon recorded to designate the codes in the margin and the designated area or areas, a visible record of same may be provided by either having the wand incorporate a pen as noted above or by developing the magnetic recording on this grid sheet in a magnetic reproducing apparatus having magnetic toner.

The magnetic grid sheet can have a multi-resolution magnetic grid capability. For example, the magnetic grid sheet may have a first magnetic layer coated on the support with this layer having a density or material of higher coercivity, say 2000 oersteds, and a top layer with a grid of lower coercivity (600–800 oersteds). The recordings in these layers can be of different orientation as well. The different layers may have grids recorded thereon of different frequencies to allow a dual resolution tablet for defining areas for selective area treatment. A circuit in the wand can be provided for allowing selection of the higher or lower fields. In still another embodiment, the magnetized grid lines may be parallel lines directed at a 45 degree angle with the edges of the sheet. With alternate lines magnetized with different polarity the movement of the wand 194 can then generate signals as it moves in one direction parallel to one edge and then moves in a second direction parallel to a second edge that is perpendicular to the first edge. Directional movement, say left or right, of the wand can be determined by establishing a convention or a protocol as to the order of movement, i.e., clockwise movement after the first point, "a", is reached.

With the apparatus and method of the invention, the generation of pulses at reasonably high resolution can provide for storage of the many points formed during tracing of the rectangle or other shape and thereby obviate the need for software to calculate an area from only two points.

The invention, in its broader aspects, is not limited to electrophotography, but may also find utility in other applications where selective reproduction is desired for example, ink jet thermal printing, etc. wherein the original image of the document is electronically scanned and only a selected area printed based upon inputs provided by the operator during the digitizing process.

The invention has been described with reference to a sheet with magnetized grid pattern; however, in its broader aspects other sheets such as those that may be optically detected may also be suitable with a corresponding change in sensor to a photosensor or the like.

Although the above detailed description has been made with particular reference to a preferred embodiment, it will be understood that variations and modifications can be effected within the spirit and scope of the present invention.

I claim:

1. A method of digitizing a document sheet to identify the location of one or more points thereon, said method comprising the steps of placing a sheet having a grid pattern upon the document sheet;

moving a sensor that is sensitive to said grid across the grid sheet to a point to be digitized;

generating pulses in said sensor in response to such movement;

counting the pulses generated; and in response to such count, generating a signal representative of the digitized value of said point.

2. The method according to claim 1 and including the step of storing said signal as a data signal; and in response to said data signal adjusting a reproduction operation of said document sheet to modify the reproduction from the original.

3. The method according to claim 2 and wherein the adjustment of the reproduction operator comprises the step of forming on the reproduction screen pattern of an image corresponding to a continuous tone image appearing on the document sheet.

4. The method according to claim 2 and wherein the adjustment of the reproduction operation comprises the step of eliminating of a portion of information appearing on the document sheet from the reproduction.

5. The method according to claim 2 and wherein the adjustment of the reproduction operation comprises the step of reproducing on the reproduction at least some of the information appearing on the document sheet but in a different color.

6. The method according to claim 2 and wherein the adjustment of the reproduction operation comprises the step of providing information on the reproduction not appearing on the document sheet.

7. The method according to claims 1–6 and wherein the grid pattern is formed of magnetic material and the sensor employs a flux sensor which senses a magnetic flux.

8. The method according to claim 7 and wherein the sensor modifies the magnetic characteristic of the sheet with the grid pattern to provide a record on the grid sheet of the point or points digitized.

9. The method of claim 8 and wherein the grid sheet is fed through a document feeder and the magnetic characteristics of the grid sheet are used to generate signals to set a reproduction operation employing selective area treatment for reproduction of the document sheet.

10. Apparatus for digitizing a document sheet to identify the location of one or more points thereon, said apparatus comprising including the combination of:

a sheet having a grid.. pattern for placement upon a document sheet to be digitized;

a wand including a sensor, the wand being movable over the grid sheet to a point to be digitized;

the sensor including means responsive to said grid for generating pulses in said sensor in response to such movement;

means for counting the pulses generated; and means responsive to such count for generating a signal representative of the digitized value of said point.

11. The apparatus of claim 10 and including means for storing said signal as a data signal; and means responsive to said data signal for adjusting a reproduction operation of said document sheet to modify the reproduction from the original.

12. The apparatus of claim 11 and wherein the adjustment of the reproduction operation comprises the forming on the reproduction screen pattern of an image corresponding to a continuous tone image appearing on the document sheet.

13. The apparatus according to claim 11 and wherein the adjustment of the reproduction operator comprises eliminating of a portion of information appearing on the document sheet from the reproduction.

14. The apparatus of claim 10 and wherein the adjustment of the reproduction operation comprises reproducing on the reproduction at least some of the information appearing on the document sheet but in a different color.

15. The apparatus of claim 11 and wherein the adjustment of the reproduction operation comprises providing information on the reproduction not appearing on the document sheet.

16. The apparatus according to claims 10–15 and wherein the grid pattern is formed of magnetic material and the sensor employs a flux sensor which senses a magnetic flux.

17. The apparatus according to claim 16 and wherein the sensor modifies the magnetic characteristic of the sheet to provide a record on the sheet of the point or points digitized.

18. The apparatus according to claim 17 and including document feeding means and means for generating signals responsive to magnet characteristics on a grid sheet and means responsive to such signals for adjusting a reproduction operation for selective area treatment.

19. A method of reproducing a document sheet so that reproductions thereof are provided with a selective area treatment, said method comprising the steps of:

placing a sheet having a magnetic material upon the document sheet to be reproduced with a selective area treatment;

moving a magnetic writer across the sheet to record on the magnetic sheet an area or one or more points identifying an area of the document sheet to receive a selective area treatment;

reading the magnetic sheet in a magnetic reader to generate signals related to the area selected for selected area treatment; and in response to said signals adjusting a reproduction operation for reproducing said document sheet so that a reproduction(s) thereof is produced with said selective area treatment.

20. The method of claim 19 and wherein the selective area treatment comprises forming of a screen pattern in an area of the reproduction.

21. The method of claim 19 and wherein the selective area treatment comprises the step of erasing a portion of an area appearing on the original.

22. The method of claim 19 and wherein the selective area treatment comprises reproducing an area in the reproduction in a color different than that appearing in the original and different than that for reproducing other information on the original.

23. The method of claim 19 and wherein the selective area treatment comprises the addition of information not appearing in said original to said area.

24. The method of claims 19–23 and wherein the step of adjusting a reproduction operation comprises an electrophotographic reproduction operation.

* * * * *